US008227385B2

(12) United States Patent
Tagawa et al.

(10) Patent No.: US 8,227,385 B2
(45) Date of Patent: Jul. 24, 2012

(54) LUBRICANT BASE OIL, METHOD FOR PRODUCTION THEREOF, AND LUBRICANT OIL COMPOSITION

(75) Inventors: Kazuo Tagawa, Yokohama (JP); Shinichi Shirahama, Yokohama (JP); Masahiro Taguchi, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 12/934,472

(22) PCT Filed: Mar. 23, 2009

(86) PCT No.: PCT/JP2009/055690

§ 371 (c)(1), (2), (4) Date: Sep. 24, 2010

(87) PCT Pub. No.: WO2009/119520

PCT Pub. Date: Oct. 1, 2009

(65) Prior Publication Data

US 2011/0049009 A1 Mar. 3, 2011

(30) Foreign Application Priority Data

Mar. 25, 2008 (JP) ..... P2008-078570

(51) Int. Cl.
*C10M 169/04* (2006.01)
*C10G 71/00* (2006.01)

(52) U.S. Cl. ..... 508/110; 208/18

(58) Field of Classification Search ..... 508/110, 508/552; 208/18

See application file for complete search history.

(56) References Cited

U.S. PATENT DOCUMENTS

| | | | | |
|---|---|---|---|---|
| 6,103,099 | A * | 8/2000 | Wittenbrink et al. | 208/27 |
| 6,179,994 | B1 * | 1/2001 | Clark et al. | 208/27 |
| 6,420,618 | B1 * | 7/2002 | Berlowitz et al. | 585/310 |
| 2004/0065588 | A1 | 4/2004 | Genetti et al. | |
| 2004/0129603 | A1 | 7/2004 | Fyfe et al. | |
| 2004/0154958 | A1 | 8/2004 | Alexander et al. | |
| 2008/0029431 | A1 | 2/2008 | Alexander et al. | |
| 2010/0016195 | A1 | 1/2010 | Shirahama et al. | |
| 2010/0035777 | A1 | 2/2010 | Sano et al. | |

FOREIGN PATENT DOCUMENTS

| | | | |
|---|---|---|---|
| EP | 1845151 | | 10/2007 |
| EP | 2009084 | | 12/2008 |
| JP | 4-36391 | A | 2/1992 |
| JP | 4-68082 | A | 3/1992 |
| JP | 4-120193 | A | 4/1992 |
| JP | 2004-182931 | A | 7/2004 |
| JP | 2004-250504 | A | 9/2004 |
| JP | 2005-154760 | A | 6/2005 |
| JP | 2005-213447 | | 8/2005 |
| JP | 2006-502298 | A | 1/2006 |
| JP | 2006-502303 | A | 1/2006 |
| JP | 2006-241436 | | 9/2006 |
| JP | 2006-521416 | A | 9/2006 |
| JP | 2007-297528 | A | 11/2007 |
| WO | 2007/105769 | | 9/2007 |
| WO | 2007/114132 | | 10/2007 |
| WO | 2008/123246 | A1 | 10/2008 |
| WO | 2008/123249 | A1 | 10/2008 |

OTHER PUBLICATIONS

U.S. Appl. No. 12/812,524 to Shigeki Matsui et al., which application is the National Stage of PCT/JP2009/050233 filed Jan. 9, 2009.
U.S. Appl. No. 12/865,921 to Kazuaki Hayasaka, which application is the National Stage of PCT/JP2009/051906 filed on Feb. 4, 2009.
U.S. Appl. No. 12/933,805 to Hajime Nakao et al., which application is the National Stage of PCT/JP2009/054778 filed on Mar. 12, 2009.
U.S. Appl. No. 12/934,374 to Kazuo Tagawa, which application is the National Stage of PCT/JP2009/055667 filed on Mar. 23, 2009.
U.S. Appl. No. 12/934,431 to Kazuo Tagawa et al., which application is the National Stage of PCT/JP2009/055666 filed on Mar. 23, 2009.
International Search Report for PCT/JP2009/055690, mailed Jun. 16, 2009.
International Preliminary Report on Patentability for PCT/JP2009/055690, mailed Nov. 18, 2010.
Search report from E.P.O. that issued with respect to patent family member European Patent Application No. 09723708.5, mail date is May 23, 2011.
Sharma and Stipanovic, "Predicting low temperature lubricant rheology using nuclear magnetic resonance spectroscopy and mass spectrometry", Tribology Letters, vol. 16, No. 1-2, Feb. 2004, pp. 11-19.
E.P.O. Office action that issued with respect to patent family member European Patent Application No. 09723708.5, mail date is Mar. 2, 2012.
Japanese Office action that issued with respect to counterpart Japanese Patent Application No. 2008-078570, dated May 22, 2012.
Sato et al., "Separation of n-Paraffin and 1-Olefin in Shale Oil by Urea Adduct Method", Sekiyu Gakkaishi, vol. 39, No. 5, 1996, p. 365-368 with partial English translation.

* cited by examiner

*Primary Examiner* — Walter D Griffin
*Assistant Examiner* — Francis C Campanell
(74) *Attorney, Agent, or Firm* — Greenblum & Bernstein, P.L.C.

(57) ABSTRACT

The lubricating base oil of the invention has a urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher. The method for producing a lubricating base oil of the invention comprises a step of hydrocracking/hydroisomerizing a feedstock oil containing normal paraffins so as to obtain a treated product having an urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher. The lubricating oil composition of the invention comprises the lubricating base oil of the invention.

3 Claims, No Drawings

LUBRICANT BASE OIL, METHOD FOR PRODUCTION THEREOF, AND LUBRICANT OIL COMPOSITION

TECHNICAL FIELD

The present invention relates to a lubricant base oil, a method for producing thereof and a lubricant oil composition.

BACKGROUND ART

The requirements for energy savings and safety of lubricant oils have become increasingly stringent in recent years. In terms of energy savings, base oils are required to have high viscosity indexes in order to lower the viscosity to a practical range, while maintaining viscosity at the maximum design temperature of the device. In industrial fields, in particular, ISO VG32 grade oils with a kinematic viscosity at 40° C. of approximately 32 $mm^2/s$ are primarily used, and properties in this viscosity range are desired. In recent years, base oils with lower low-temperature viscosities have been desired for the purpose of lowering the viscosity resistance at device cold-start. Improvement in the low-temperature characteristic is currently achieved, in most cases, by adding a pour point depressant or the like to a lubricating base oil such as a highly refined mineral oil, to improve the low-temperature characteristic (see Patent documents 1-3, for example).

From the viewpoint of safety, on the other hand, it is desirable to remove heavy metals in the lubricant oil, while also lowering sulfur content. In addition, the Japan Fire Service Law places strict limits at factories and the like, regarding total factory holding volumes at the flash points of lubricant oils, and therefore in consideration of handling issues there is a strong demand for lubricant oils with flash points of 250° C. and higher which are non-hazardous substances according to the Japan Fire Service Law.

Known processes for producing high-viscosity-index base oils to meet this demand include processes in which feedstock oils containing natural or synthetic normal paraffins are subjected to lubricating base oil refining by hydrocracking/hydroisomerization (see Patent documents 4-6, for example). There are also known methods for producing lubricating base oils designed with high flash points and lubricating oil compositions with high flash points, which avoid sacrificing other properties (see Patent documents 7-8, for example).

The properties evaluated for the low-temperature viscosity characteristic of lubricating base oils and lubricant oils are generally the pour point, clouding point and freezing point. Methods are also known for evaluating the low-temperature viscosity characteristic for lubricating base oils, according to their normal paraffin or isoparaffin contents.

[Patent document 1] Japanese Unexamined Patent Application Publication HEI No. 4-36391

[Patent document 2] Japanese Unexamined Patent Application Publication HEI No. 4-68082

[Patent document 3] Japanese Unexamined Patent Application Publication HEI No. 4-120193

[Patent document 4] Japanese Unexamined Patent Application Publication No. 2005-154760

[Patent document 5] Japanese Patent Public Inspection No. 2006-502298

[Patent document 6] Japanese Patent Public Inspection No. 2006-502303

[Patent document 7] Japanese Unexamined Patent Application Publication No. 2004-250504

[Patent document 8] Japanese Unexamined Patent Application Publication No. 2004-182931

DISCLOSURE OF THE INVENTION

Problems to be Solved by the Invention

In light of these circumstances, the use of poly-α-olefins has been unavoidable for achieving a flash point of 250° C. or higher with base oils having kinematic viscosities at 40° C. of lower than 50 $mm^2/s$ using the current technology, and this increases product cost. Moreover, since poly-α-olefins are synthetic oils and their viscosity indexes are usually about 135, it has been difficult to achieve even higher viscosity indexes by these methods to realize energy savings.

With mineral oil-based base oils, on the other hand, it has been difficult to increase both the viscosity index and flash point by conventional solvent refining or hydrocracking. When increased energy savings depends on additives, depletion and deterioration of the additives can reduce long-term reliability. Some effect can be achieved by lowering the viscosity of the base oil that is used to improve energy efficiency, but it is not possible to solve both of the aforementioned problems simply by reducing the viscosity due to the lower flash point.

It has been attempted to optimize the conditions for hydrocracking/hydroisomerization in refining processes for lubricating base oils that make use of hydrocracking/hydroisomerization as mentioned above, from the viewpoint of increasing the isomerization rate from normal paraffins to isoparaffins and improving the low-temperature viscosity characteristic by lowering the viscosity of the lubricating base oil, but because the viscosity-temperature characteristic (especially high-temperature viscosity characteristic) and the low-temperature viscosity characteristic are in an inverse relationship, it has been extremely difficult to achieve both of these. For example, increasing the isomerization rate from normal paraffins to isoparaffins improves the low-temperature viscosity characteristic but results in an unsatisfactory viscosity-temperature characteristic, including a reduced viscosity index. The fact that the above-mentioned indexes such as pour point and freezing point are often unsuitable as indexes for evaluating the low-temperature viscosity characteristic of lubricating base oils is another factor that impedes optimization of the hydrocracking/hydroisomerization conditions.

The present invention has been accomplished in light of these circumstances, and its object is to provide a lubricating base oil capable of exhibiting a satisfactory balance among high levels of the viscosity-temperature characteristic, low-temperature viscosity characteristic and flash point property, as well as a method for its production and a lubricating oil composition comprising the lubricating base oil.

Means for Solving the Problems

In order to solve the problems described above, the invention provides a lubricating base oil having a urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher.

The urea adduct value according to the invention is measured by the following method. A 100 g weighed portion of sample oil (lubricating base oil) is placed in a round bottom flask, 200 g of urea, 360 ml of toluene and 40 ml of methanol are added and the mixture is stirred at room temperature for 6 hours. This produces white particulate crystals as urea adduct in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a reparatory funnel, and the toluene phase is washed 3 times with 300 ml of purified water. After dewatering treatment of the toluene phase by addition of a desiccant (sodium sulfate), the toluene is distilled off. The proportion (mass percentage) of urea adduct obtained in this manner with respect to the sample oil is defined as the urea adduct value.

The kinematic viscosity at 40° C. according to the invention, and the kinematic viscosity at 100° C. and viscosity index mentioned hereunder, are the kinematic viscosity at 40° C. or 100° C. and viscosity index as measured according to JIS K 2283-1993.

The CCS viscosity at −35° C. for the purpose of the invention is the viscosity measured according to JIS K 2010-1993.

The flash point for the purpose of the invention is the flash point measured according to JIS K 2265 (open-cup flash point).

According to the lubricating base oil of the invention, wherein the urea adduct value, kinematic viscosity at 40° C., viscosity index, CCS viscosity and flash point satisfy the conditions specified above, it is possible to exhibit a satisfactory balance among high levels for the viscosity-temperature characteristic, low-temperature viscosity characteristic and flash point property. When an additive such as a pour point depressant is added to the lubricating base oil of the invention, the effect of its addition is exhibited more effectively. Thus, the lubricating base oil of the invention is highly useful as a lubricating base oil that can meet recent demands for the low-temperature viscosity characteristic, viscosity-temperature characteristic and flash point property. In addition, according to the lubricating base oil of the invention it is possible to reduce viscosity resistance and stirring resistance in a practical temperature range due to its aforementioned superior viscosity-temperature characteristic. In particular, the lubricating base oil of the invention can exhibit this effect by significantly reducing viscosity resistance and stirring resistance under low temperature conditions of 0° C. and below, and it is therefore highly useful for reducing energy loss and achieving energy savings in devices in which the lubricating base oil is applied.

While efforts are being made to improve the isomerization rate from normal paraffins to isoparaffins in conventional refining processes for lubricating base oils by hydrocracking and hydroisomerization, as mentioned above, the present inventors have found that it is difficult to satisfactorily improve the low-temperature viscosity characteristic simply by reducing the residual amount of normal paraffins. That is, although the isoparaffins produced by hydrocracking and hydroisomerization also contain components that adversely affect the low-temperature viscosity characteristic, this fact has not been fully appreciated in the conventional methods of evaluation. Methods such as gas chromatography (GC) and NMR are also applied for analysis of normal paraffins and isoparaffins, but the use of these analysis methods for separation and identification of the components in isoparaffins that adversely affect the low-temperature viscosity characteristic involves complicated procedures and is time-consuming, making them ineffective for practical use.

With measurement of the urea adduct value according to the invention, on the other hand, it is possible to accomplish precise and reliable collection of the components in isoparaffins that can adversely affect the low-temperature viscosity characteristic, as well as normal paraffins when normal paraffins are residually present in the lubricating base oil, as urea adduct, and it is therefore an excellent indicator for evaluation of the low-temperature viscosity characteristic of lubricating base oils. The present inventors have confirmed that when analysis is conducted using GC and NMR, the main urea adducts are urea adducts of normal paraffins and of isoparaffins having 6 or greater carbon atoms from the main chain to the point of branching.

The invention further provides a method for producing a lubricating base oil comprising a step of:

hydrocracking/hydroisomerizing a feedstock oil containing normal paraffins so as to obtain a treated product having an urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher.

According to the method for producing a lubricating base oil of the invention, a feedstock oil containing normal paraffins is subjected to hydrocracking/hydroisomerization so as to obtain a treated product having an urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher, whereby it is possible to reliably obtain a lubricating base oil having high levels of properties including the viscosity-temperature characteristic, low-temperature viscosity characteristic and flash point property.

The invention still further provides a lubricating oil composition comprising the aforementioned lubricating base oil of the invention.

Since a lubricating oil composition according to the invention contains a lubricating base oil of the invention having the excellent properties described above, it is useful as a lubricating oil composition capable of exhibiting high levels of the viscosity-temperature characteristic, low-temperature viscosity characteristic and flash point property. Since the effects of adding additives to the lubricating base oil of the invention can be effectively exhibited, as explained above, various additives may be optimally added to the lubricating oil composition of the invention.

Effect of the Invention

According to the invention there are provided: a lubricating base oil capable of exhibiting high levels of the viscosity-temperature characteristic, low-temperature viscosity characteristic and flash point property, as well as a method for producing thereof, and a lubricating oil composition comprising the lubricating base oil.

BEST MODE FOR CARRYING OUT THE INVENTION

Preferred embodiments of the invention will now be described in detail.

The lubricating base oil of the invention has a urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher.

Also, from the viewpoint of improving the low-temperature viscosity characteristic without impairing the viscosity-temperature characteristic, the urea adduct value of the lubricating base oil of the invention must be not greater than 4% by mass as mentioned above, but it is preferably not greater than 3.5% by mass, more preferably not greater than 3% by mass and even more preferably not greater than 2.5% by mass. The urea adduct value of the lubricating base oil may even be 0% by mass, but from the viewpoint of obtaining a lubricating base oil with a sufficient low-temperature viscosity characteristic, high viscosity index and high flash point, and also of relaxing the isomerization conditions and improving economy, it is preferably 0.1% by mass or greater, more preferably 0.5% by mass or greater and most preferably 0.8% by mass or greater.

From the viewpoint of improving the viscosity-temperature characteristic, the viscosity index of the lubricating base oil of the invention must be 140 or greater as mentioned above, but it is preferably 145 or greater, more preferably 150 or greater, even more preferably 155 or greater and most preferably 160 or greater. If the viscosity index is less than 140 it may not be possible to obtain effective fuel efficiency, and this is undesirable.

The kinematic viscosity at 40° C. of the lubricating base oil of the invention must be 25-50 $mm^2/s$, but it is preferably 26-40 $mm^2/s$, more preferably 27-35 $mm^2/s$, even more preferably 28-34 $mm^2/s$, and most preferably 28-33 $mm^2/s$. If the kinematic viscosity at 40° C. is less than 25 $mm^2/s$, problems in terms of oil film retention and evaporation may occur at lubricated sections, which is undesirable. If the kinematic viscosity at 40° C. is 50 $mm^2/s$ or greater, the low-temperature viscosity characteristic may be undesirably impaired.

The kinematic viscosity at 100° C. of the lubricating base oil of the invention is preferably 4.0-10.0 $mm^2/s$, more preferably 4.5-9.0 $mm^2/s$ and most preferably 5.0-8.0 $mm^2/s$. A kinematic viscosity at 100° C. of lower than 4.0 $mm^2/s$ for the lubricating base oil is not preferred from the standpoint of evaporation loss. If the kinematic viscosity at 100° C. is greater than 10.0 $mm^2/s$, the low-temperature viscosity characteristic may be undesirably impaired.

The CCS viscosity at −35° C. of the lubricating base oil of the invention must be not greater than 15,000 mPa·s, but it is preferably not greater than 12,000 mPa·s, more preferably not greater than 10,000 mPa·s, even more preferably not greater than 9,000 mPa·s and most preferably not greater than 8,000 mPa·s. If the CCS viscosity at −35° C. exceeds 15,000 mPa·s, the low-temperature flow properties of lubricant oils employing the lubricating base oil will tend to be reduced, and this is undesirable from the viewpoint of energy savings. There are no particular restrictions on the lower limit of the CCS viscosity, but from the viewpoint of relation with the urea adduct value, and in terms of balance among the viscosity index, flash point and economy including yield, it is 2000 mPa·s or greater, preferably 3000 mPa·s or greater and most preferably 3500 mPa·s or greater.

The flash point of the lubricating base oil of the invention must be 250° C. or higher, but it is preferably 253° C. or higher, more preferably 255° C. or higher and even more preferably 260° C. or higher. If the flash point is lower than 250° C., the oil is no longer a non-risk oil according to the Japan Fire Service Law, and problems of safety during high-temperature use may arise.

The feedstock oil used for production of the lubricating base oil of the invention may include normal paraffins or normal paraffin-containing wax. The feedstock oil may be a mineral oil or a synthetic oil, or a mixture of two or more thereof.

The feedstock oil used for the invention preferably is a wax-containing starting material that boils in the range of lubricant oils according to ASTM D86 or ASTM D2887. The wax content of the feedstock oil is preferably between 50% by mass and 100% by mass based on the total amount of the feedstock oil. The wax content of the starting material can be measured by a method of analysis such as nuclear magnetic resonance spectroscopy (ASTM D5292), correlative ring analysis (n-d-M) (ASTM D3238) or the solvent method (ASTM D3235).

As examples of wax-containing starting materials there may be mentioned oils derived from solvent refining methods, such as raffinates, partial solvent dewaxed oils, depitched oils, distillates, reduced pressure gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Commercial normal paraffin-containing feedstock oils are also available. Specifically, there may be mentioned Paraflint 80 (hydrogenated Fischer-Tropsch wax) and Shell MDS Waxy Raffinate (hydrogenated and partially isomerized heart cut distilled synthetic wax raffinate).

Feedstock oil derived from solvent extraction is obtained by feeding a high boiling point petroleum fraction from atmospheric distillation to a vacuum distillation apparatus and subjecting the distillation fraction to solvent extraction. The residue from vacuum distillation may also be depitched. In solvent extraction methods, the aromatic components are dissolved in the extract phase while leaving more paraffinic components in the raffinate phase. Naphthenes are distributed in the extract phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a fuel oil hydrocracking apparatus, using a fuel oil hydrocracking apparatus with higher hydrocracking performance.

The lubricating base oil of the invention may be obtained through a step of hydrocracking/hydroisomerizing the feedstock oil so as to obtain a treated product having an urea adduct value of not greater than 4% by mass and a viscosity index of 100 or higher. The hydrocracking/hydroisomerization step is not particularly restricted so long as it satisfies the aforementioned conditions for the urea adduct value and viscosity index of the treated product. A preferred hydrocracking/hydroisomerization step according to the invention comprises:

a first step in which a normal paraffin-containing feedstock oil is subjected to hydrotreatment using a hydrotreatment catalyst, a second step in which the treated product obtained from the first step is subjected to hydrodewaxing using a hydrodewaxing catalyst, and a third step in which the treated product obtained from the second step is subjected to hydrorefining using a hydrorefining catalyst.

Conventional hydrocracking/hydroisomerization also includes a hydrotreatment step in an early stage of the hydrodewaxing step, for the purpose of desulfurization and denitrogenization to prevent poisoning of the hydrodewaxing catalyst. In contrast, the first step (hydrotreatment step) according to the invention is carried out to decompose a portion (for example, about 10% by mass and preferably 1-10% by mass) of the normal paraffins in the feedstock oil at an early stage of the second step (hydrodewaxing step), thus allowing desulfurization and denitrogenization in the first step as well, although the purpose differs from that of conventional hydrotreatment. The first step is preferred in order to reliably limit the urea adduct value of the treated product obtained after the third step (the lubricating base oil) to not greater than 4% by mass.

As hydrogenation catalysts to be used in the first step there may be mentioned catalysts containing Group 6 metals and Group 8-10 metals, as well as mixtures thereof. As preferred metals there may be mentioned nickel, tungsten, molybdenum and cobalt, and mixtures thereof. The hydrogenation catalyst may be used in a form with the aforementioned metals supported on a heat-resistant metal oxide carrier, and normally the metal will be present on the carrier as an oxide or sulfide. When a mixture of metals is used, it may be used as a bulk metal catalyst with an amount of metal of at least 30% by mass based on the total amount of the catalyst. The metal oxide carrier may be an oxide such as silica, alumina, silica-alumina or titania, with alumina being preferred. Preferred alumina is γ or β porous alumina. The loading mass of the metal is preferably in the range of 0.1-35% by mass based on the total amount of the catalyst. When a mixture of a metal of Groups 9-10 and a metal of Group 6 is used, preferably the metal of Group 9 or 10 is present in an amount of 0.1-5% by mass and the metal of Group 6 is present in an amount of 5-30% by mass based on the total amount of the catalyst. The loading mass of the metal may be measured by atomic absorption spectrophotometry or inductively coupled plasma emission spectroscopy, or the individual metals may be measured by other ASTM methods.

The acidity of the metal oxide carrier can be controlled by controlling the addition of additives and the property of the metal oxide carrier (for example, controlling the amount of silica incorporated in a silica-alumina carrier). As examples of additives there may be mentioned halogens, especially fluorine, and phosphorus, boron, yttria, alkali metals, alkaline earth metals, rare earth oxides and magnesia. Co-catalysts such as halogens generally raise the acidity of metal oxide carriers, while weakly basic additives such as yttria and magnesia can be used to lower the acidity of the carrier.

As regards the hydrotreatment conditions, the treatment temperature is preferably 150-450° C. and more preferably 200-400° C., the hydrogen partial pressure is preferably 1400-20,000 kPa and more preferably 2800-14,000 kPa, the liquid space velocity (LHSV) is preferably 0.1-10 $hr^{-1}$ and more preferably 0.1-5 $hr^{-1}$, and the hydrogen/oil ratio is preferably 50-1780 $m^3/m^3$ and more preferably 89-890 $m^3/m^3$. These conditions are only for example, and the hydrotreatment conditions in the first step may be appropriately selected for different starting materials, catalysts and apparatuses, in order to obtain the specified urea adduct value and viscosity index for the treated product obtained after the third step.

The treated product obtained by hydrotreatment in the first step may be directly supplied to the second step, but a step of stripping or distillation of the treated product and separating removal of the gas product from the treated product (liquid product) is preferably conducted between the first step and second step. This can reduce the nitrogen and sulfur contents in the treated product to levels that will not affect prolonged use of the hydrodewaxing catalyst in the second step. The main objects of separating removal by stripping and the like are gaseous contaminants such as hydrogen sulfide and ammonia, and stripping can be accomplished by ordinary means such as a flash drum, distiller or the like.

When the hydrotreatment conditions in the first step are mild, residual polycyclic aromatic components can potentially remain depending on the starting material used, and such contaminants may be removed by hydrorefining in the third step.

The hydrodewaxing catalyst used in the second step may contain crystalline or amorphous materials. Examples of crystalline materials include molecular sieves having 10- or 12-membered ring channels, composed mainly of aluminosilicates (zeolite) or silicoaluminophosphates (SAPO). Specific examples of zeolites include ZSM-22, ZSM-23, ZSM-35, ZSM-48, ZSM-57, ferrierite, ITQ-13, MCM-68, MCM-71 and the like. ECR-42 may be mentioned as an example of an aluminophosphate. Examples of molecular sieves include zeolite beta and MCM-68. Among the above there are preferably used one or more selected from among ZSM-48, ZSM-22 and ZSM-23, with ZSM-48 being particularly preferred. The molecular sieves are preferably hydrogen-type. Reduction of the hydrodewaxing catalyst may occur at the time of hydrodewaxing, but alternatively a hydrodewaxing catalyst that has been previously subjected to reduction treatment may be used for the hydrodewaxing.

As amorphous materials for the hydrodewaxing catalyst there may be mentioned alumina doped with Group 3 metals, fluorinated alumina, silica-alumina, fluorinated silica-alumina, silica-alumina and the like.

A preferred mode of the dewaxing catalyst is a bifunctional catalyst, i.e. one carrying a metal hydrogenated component which is at least one metal of Group 6, at least one metal of Groups 8-10 or a mixture thereof. Preferred metals are precious metals of Groups 9-10, such as Pt, Pd or mixtures thereof. Such metals are supported at preferably 0.1-30% by mass based on the total amount of the catalyst. The method for preparation of the catalyst and loading of the metal may be, for example, an ion-exchange method or impregnation method using a decomposable metal salt.

When molecular sieves are used, they may be compounded with a binder material that is heat resistant under the hydrodewaxing conditions, or they may be binderless (self-binding). As binder materials there may be mentioned inorganic oxides, including silica, alumina, silica-alumina, two-component combinations of silica with other metal oxides such as titania, magnesia, yttria and zirconia, and three-component combinations of oxides such as silica-alumina-yttria, silica-alumina-magnesia and the like. The amount of molecular sieves in the hydrodewaxing catalyst is preferably 10-100% by mass and more preferably 35-100% by mass based on the total amount of the catalyst. The hydrodewaxing catalyst may be formed by a method such as spray-drying or extrusion. The hydrodewaxing catalyst may be used in sulfided or non-sulfided form, although a sulfided form is preferred.

As regards the hydrodewaxing conditions, the temperature is preferably 250-400° C. and more preferably 275-350° C., the hydrogen partial pressure is preferably 791-20,786 kPa (100-3000 psig) and more preferably 1480-17,339 kPa (200-2500 psig), the liquid space velocity is preferably 0.1-10 $hr^{-1}$ and more preferably 0.1-5 $hr^{-1}$, and the hydrogen/oil ratio is preferably 45-1780 $m^3/m^3$ (250-10,000 scf/B) and more preferably 89-890 $m^3/m^3$ (500-5000 scf/B). These conditions are only for example, and the hydrodewaxing conditions in the second step may be appropriately selected for different starting materials, catalysts and apparatuses, in order to obtain the specified urea adduct value and viscosity index for the treated product obtained after the third step.

The treated product that has been hydrodewaxed in the second step is then supplied to hydrorefining in the third step. Hydrorefining is a faun of mild hydrotreatment aimed at removing residual heteroatoms and color phase components while also saturating the olefins and residual aromatic compounds by hydrogenation. The hydrorefining in the third step may be carried out in a cascade fashion with the dewaxing step.

The hydrorefining catalyst used in the third step is preferably one comprising a Group 6 metal, a Group 8-10 metal or a mixture thereof supported on a metal oxide support. As preferred metals there may be mentioned precious metals, and especially platinum, palladium and mixtures thereof. When a mixture of metals is used, it may be used as a bulk metal catalyst with an amount of metal of 30% by mass or greater based on the mass of the catalyst. The metal content of the catalyst is preferably not greater than 20% by mass non-precious metals and preferably not greater than 1% by mass precious metals. The metal oxide support may be either an amorphous or crystalline oxide. Specifically, there may be mentioned low acidic oxides such as silica, alumina, silica-alumina and titania, with alumina being preferred. From the viewpoint of saturation of aromatic compounds, it is preferred to use a hydrorefining catalyst comprising a metal with a relatively powerful hydrogenating function supported on a porous carrier.

As preferred hydrorefining catalysts there may be mentioned meso-microporous materials belonging to the M41S class or line of catalysts. M41S line catalysts are meso-microporous materials with high silica contents, and specific ones include MCM-41, MCM-48 and MCM-50. The hydrorefining catalyst has a pore size of 15-100 Å, and MCM-41 is particularly preferred. MCM-41 is an inorganic porous non-laminar phase with a hexagonal configuration and pores of uniform size. The physical structure of MCM-41 manifests as straw-like bundles with straw openings (pore cell diameters) in the range of 15-100 angstroms. MCM-48 has cubic symmetry, while MCM-50 has a laminar structure. MCM-41 may also have a structure with pore openings having different meso-microporous ranges. The meso-microporous material may contain metal hydrogenated components, the metal consisting of one or more Group 8, 9 or 10 metals, and preferred as metal hydrogenated components are precious metals, especially Group 10 precious metals, and most preferably Pt, Pd or their mixtures.

As regards the hydrorefining conditions, the temperature is preferably 150-350° C. and more preferably 180-250° C., the total pressure is preferably 2859-20,786 kPa (approximately 400-3000 psig), the liquid space velocity is preferably 0.1-5 $hr^{-1}$ and more preferably 0.5-3 $hr^{-1}$, and the hydrogen/oil ratio is preferably 44.5-1780 $m^3/m^3$ (250-10,000 scf/B). These conditions are only for example, and the hydrorefining conditions in the third step may be appropriately selected for different starting materials and treatment apparatuses, so that the urea adduct value and viscosity index for the treated product obtained after the third step satisfy the respective conditions specified above.

The treated product obtained after the third step may be subjected to distillation or the like as necessary for separating removal of certain components.

The lubricating base oil of the invention obtained by the production method described above is not restricted in terms of its other properties so long as the urea adduct value and viscosity index satisfy their respective conditions, but the lubricating base oil of the invention preferably also satisfies the conditions specified below.

The saturated components content of the lubricating base oil of the invention is preferably 90% by mass or greater, more preferably 93% by mass or greater and even more preferably 95% by mass or greater based on the total amount of the lubricating base oil. The proportion of cyclic saturated components among the saturated components is preferably 0.1-10% by mass, more preferably 0.5-5% by mass and even more preferably 0.8-3% by mass. If the saturated components content and proportion of cyclic saturated components among the saturated components both satisfy these respective conditions, it will be possible to achieve adequate levels for the viscosity-temperature characteristic and heat and oxidation stability, while additives added to the lubricating base oil will be kept in a sufficiently stable dissolved state in the lubricating base oil, and it will be possible for the functions of the additives to be exhibited at a higher level. In addition, the saturated components content and proportion of cyclic saturated components among the saturated components satisfying the aforementioned conditions can improve the frictional properties of the lubricating base oil itself, resulting in a greater friction reducing effect and thus increased energy savings.

If the saturated components content is less than 90% by mass, the viscosity-temperature characteristic, heat and oxidation stability and frictional properties will tend to be inadequate. If the proportion of cyclic saturated components among the saturated components is less than 0.1% by mass, the solubility of the additives included in the lubricating base oil will be insufficient and the effective amount of additives kept dissolved in the lubricating base oil will be reduced, making it impossible to effectively achieve the function of the additives. If the proportion of cyclic saturated components among the saturated components is greater than 10% by mass, the efficacy of additives included in the lubricating base oil will tend to be reduced.

According to the invention, a proportion of 0.1-10% by mass cyclic saturated components among the saturated components is equivalent to 99.9-90% by mass acyclic saturated components among the saturated components. Both normal paraffins and isoparaffins are included by the term "acyclic saturated components". The proportions of normal paraffins and isoparaffins in the lubricating base oil of the invention are not particularly restricted so long as the urea adduct value satisfies the condition specified above, but the proportion of isoparaffins is preferably 90-99.9% by mass, more preferably 95-99.5% by mass and even more preferably 97-99% by mass, based on the total amount of the lubricating base oil. If the proportion of isoparaffins in the lubricating base oil satisfies the aforementioned conditions it will be possible to further improve the viscosity-temperature characteristic and heat and oxidation stability, while additives added to the lubricating base oil will be kept in a sufficiently stable dissolved state in the lubricating base oil and it will be possible for the functions of the additives to be exhibited at an even higher level.

The saturated components content for the purpose of the invention is the value measured according to ASTM D 2007-93 (units: % by mass).

The proportions of the cyclic saturated components and acyclic saturated components among the saturated components for the purpose of the invention are the naphthene portion (measurement of monocyclic-hexacyclic naphthenes, units: % by mass) and alkane portion (units: % by mass), respectively, both measured according to ASTM D 2786-91.

The proportion of normal paraffins in the lubricating base oil for the purpose of the invention is the value obtained by analyzing saturated components separated and fractionated by the method of ASTM D 2007-93 by gas chromatography under the following conditions, and calculating the value obtained by identifying and quantifying the proportion of normal paraffins among those saturated components, with respect to the total amount of the lubricating base oil. For identification and quantitation, a C5-C50 straight-chain normal paraffin mixture sample is used as the reference sample, and the normal paraffin content among the saturated components is determined as the proportion of the total of the peak areas corresponding to each normal paraffin, with respect to the total peak area of the chromatogram (subtracting the peak area for the diluent).

(Gas Chromatography Conditions)

Column: Liquid phase nonpolar column (length: 25 mm, inner diameter: 0.3 mmϕ, liquid phase film thickness: 0.1 μm), temperature elevating conditions: 50° C.-400° C. (temperature-elevating rate: 10° C./min).

Carrier gas: helium (linear speed: 40 cm/min)

Split ratio: 90/1

Sample injection rate: 0.5 μL (injection rate of sample diluted 20-fold with carbon disulfide).

The proportion of isoparaffins in the lubricating base oil is the value of the difference between the acyclic saturated components among the saturated components and the normal paraffins among the saturated components, based on the total amount of the lubricating base oil.

Other methods may be used for separation of the saturated components or for compositional analysis of the cyclic saturated components and acyclic saturated components, so long as they provide similar results. Examples of other methods include the method according to ASTM D 2425-93, the method according to ASTM D 2549-91, methods of high performance liquid chromatography (HPLC), and modified forms of these methods.

The aromatic components content of the lubricating base oil of the invention is preferably not greater than 5% by mass, more preferably 0.1-3% by mass and even more preferably 0.3-1% by mass based on the total amount of the lubricating base oil. If the aromatic components content exceeds the aforementioned upper limit, the viscosity-temperature characteristic, heat and oxidation stability, frictional properties, resistance to volatilization and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic components content of 0.1% by mass or greater.

The aromatic components content in this case is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The % $C_p$ value of the lubricating base oil of the invention is preferably 80 or greater, more preferably 82-99, even more preferably 85-98 and most preferably 90-97. If the % $C_p$ value of the lubricating base oil is less than 80, the viscosity-temperature characteristic, heat and oxidation stability and frictional properties will tend to be reduced, while the efficacy of additives when added to the lubricating base oil will also tend to be reduced. If the % $C_p$ value of the lubricating base oil is greater than 99, on the other hand, the additive solubility will tend to be lower.

The % $C_N$ value of the lubricating base oil of the invention is preferably not greater than 15, more preferably 1-12 and even more preferably 3-10. If the % $C_N$ value of the lubricating base oil exceeds 15, the viscosity-temperature characteristic, heat and oxidation stability and frictional properties will tend to be reduced. If the % $C_N$ is less than 1, however, the additive solubility will tend to be lower.

The % $C_A$ value of the lubricating base oil of the invention is preferably not greater than 0.7, more preferably not greater than 0.6 and even more preferably 0.1-0.5. If the % $C_A$ value of the lubricating base oil exceeds 0.7, the viscosity-temperature characteristic, heat and oxidation stability and frictional properties will tend to be reduced. The % $C_A$ value of the lubricating base oil of the invention may be zero, but the solubility of additives can be further increased with a % $C_A$ value of 0.1 or greater.

The ratio of the % $C_P$ and % $C_N$ values for the lubricating base oil of the invention is % $C_P$/% $C_N$ of preferably 7 or greater, more preferably 7.5 or greater and even more preferably 8 or greater. If the % $C_p$/% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably not greater than 200, more preferably not greater than 100, even more preferably not greater than 50 and most preferably not greater than 25. The additive solubility can be further increased if the % $C_P$/% $C_N$ ratio is not greater than 200.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the method of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The iodine value of the lubricating base oil of the invention is preferably not greater than 0.5, more preferably not greater than 0.3 and even more preferably not greater than 0.15, and although it may be less than 0.01, it is preferably 0.001 or greater and more preferably 0.05 or greater in consideration of achieving a commensurate effect, and in terms of economy. Limiting the iodine value of the lubricating base oil to not greater than 0.5 can drastically improve the heat and oxidation stability. The "iodine value" for the purpose of the invention is the iodine value measured by the indicator titration method according to JIS K 0070, "Acid numbers, Saponification Values, Iodine Values, Hydroxyl Values And Unsaponification Values Of Chemical Products".

The sulfur content in the lubricating base oil of the invention will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil will normally be 100 ppm by mass or greater. From the viewpoint of further improving the heat and oxidation stability and reducing sulfur, the sulfur content in the lubricating base oil of the invention is preferably not greater than 10 ppm by mass, more preferably not greater than 5 ppm by mass and even more preferably not greater than 3 ppm by mass.

From the viewpoint of cost reduction it is preferred to use slack wax or the like as the starting material, in which case the sulfur content of the obtained lubricating base oil is preferably not greater than 50 ppm by mass and more preferably not greater than 10 ppm by mass. The sulfur content for the purpose of the invention is the sulfur content measured according to JIS K 2541-1996.

The nitrogen content in the lubricating base oil of the invention is not particularly restricted, but is preferably not greater than 5 ppm by mass, more preferably not greater than 3 ppm by mass and even more preferably not greater than 1 ppm by mass. If the nitrogen content exceeds 5 ppm by mass, the heat and oxidation stability will tend to be reduced. The nitrogen content for the purpose of the invention is the nitrogen content measured according to JIS K 2609-1990.

If the lubricating base oil has a urea adduct value, viscosity index, CCS viscosity at −35° C. and flash point each satisfying the conditions specified above, it will be possible to achieve high levels of all the properties including viscosity-temperature characteristic, low-temperature viscosity characteristic and flash point property, and particularly to obtain an excellent low-temperature viscosity characteristic and notably reduced viscosity resistance or stirring resistance, compared to a conventional lubricating base oil of the same viscosity grade.

The pour point of the lubricating base oil of the invention is preferably not higher than −10° C., more preferably not higher than −12.5° C. and even more preferably not higher than −15.0° C., and from the viewpoint of relation with the urea adduct value, and in terms of balance among the viscosity index, flash point and economy including yield, it is preferably −40° C. or higher and more preferably −25° C. or higher. If the pour point exceeds the upper limit specified above, the low-temperature flow properties of lubricant oils employing the lubricating base oils will tend to be reduced. The pour point for the purpose of the invention is the pour point measured according to JIS K 2269-1987.

The density ($\rho_{15}$) at 15° C. of the lubricating base oil of the invention is preferably not greater than the value of ρ as represented by the following formula (1), i.e., $\rho_{15} \leqq \rho$.

$$\rho=0.0025\times kv100+0.816 \quad (1)$$

[In this equation, kv100 represents the kinematic viscosity at 100° C. ($mm^2/s$) of the lubricating base oil.]

If $\rho_{15}>\rho$, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

For example, the value of $\rho_{15}$ for the lubricating base oil of the invention is preferably not greater than 0.835 and more preferably not greater than 0.830.

The density at 15° C. for the purpose of the invention is the density measured at 15° C. according to JIS K 2249-1995.

The aniline point (AP (° C.)) of the lubricating base oil of the invention is preferably greater than or equal to the value of A as represented by the following formula (2), i.e., $AP \geqq A$.

$$A=4.3\times kv100+100 \quad (2)$$

[In this equation, kv100 represents the kinematic viscosity at 100° C. ($mm^2/s$) of the lubricating base oil.]

If $AP<A$, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

The AP value according to the invention is preferably 113° C. or higher and more preferably 119° C. or higher, and from the viewpoint of alleviating the effect on sealant contraction it is preferably not higher than 135° C. and more preferably not higher than 128° C. The aniline point for the purpose of the invention is the aniline point measured according to JIS K 2256-1985.

The NOACK evaporation loss of the lubricating base oil of the invention is not particularly restricted, but it is preferably 0.5% by mass or greater, more preferably 1.0% by mass or greater and even more preferably 1.5% by mass or greater, and also preferably not greater than 15% by mass, more preferably not greater than 10% by mass and even more preferably not greater than 8% by mass. If the NOACK evaporation loss is below the aforementioned lower limit it will tend to be difficult to improve the low-temperature viscosity characteristic. If the NOACK evaporation loss is above the upper limit, the evaporation loss of the lubricant oil will be increased when the lubricating base oil is used as a lubricant oil for an internal combustion engine, and catalyst poisoning will be undesirably accelerated as a result. The NOACK evaporation loss for the purpose of the invention is the evaporation loss as measured according to ASTM D 5800-95.

The distillation properties of the lubricating base oil of the invention are, preferably, an initial boiling point (IBP) of 290-450° C. and a final boiling point (FBP) of 430-580° C., in gas chromatography distillation.

The initial boiling point (IBP) of the lubricating base oil of the invention is preferably 410-470° C., more preferably 420-460° C. and even more preferably 430-450° C. The 10% distillation temperature (T10) is preferably 440-495° C., more preferably 450-485° C. and even more preferably 460-475° C. The 50% running point (T50) is preferably 470-530° C., more preferably 480-520° C. and even more preferably 490-510° C. The 90% running point (T90) is preferably 485-545° C., more preferably 495-535° C. and even more preferably 505-525° C. The final boiling point (FBP) is preferably 490-550° C., more preferably 500-540° C. and even more preferably 510-530° C. T90-T10 is preferably 20-80° C., more preferably 30-70° C. and even more preferably 40-60° C. FBP-IBP is preferably 50-120° C., more preferably 60-110° C. and even more preferably 70-100° C. T10-IBP is preferably 10-60° C., more preferably 15-90° C. and even more preferably 20-45° C. FBP-T90 is preferably 1-40° C., more preferably 3-30° C. and even more preferably 5-20° C.

By setting IBP, T10, T50, T90, FBP, T90-T10, FBP-IBP, T10-IBP and FBP-T90 of the lubricating base oil of the invention to within the preferred ranges specified above, it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The IBP, T10, T50, T90 and FBP values for the purpose of the invention are the running points measured according to ASTM D 2887-97.

The residual metal content in the lubricating base oil of the invention derives from metals in the catalyst or starting materials that become unavoidable contaminants during the production process, and it is preferred to thoroughly remove such residual metal contents. For example, the Al, Mo and Ni contents are each preferably not greater than 1 ppm by mass. If the metal contents exceed the aforementioned upper limit, the functions of additives in the lubricating base oil will tend to be inhibited.

The residual metal content for the purpose of the invention is the metal content as measured according to JPI-5S-38-2003.

The RBOT life of the lubricating base oil of the invention is preferably 350 min or longer, more preferably 360 min or longer and even more preferably 370 min or longer. If the RBOT life of the lubricating base oil is less than the specified lower limit, the viscosity-temperature characteristic and heat and oxidation stability of the lubricating base oil will tend to be reduced, while the efficacy of additives when added to the lubricating base oil will also tend to be reduced.

The RBOT life for the purpose of the invention is the RBOT value as measured according to JIS K 2514-1996, for a composition obtained by adding a phenol-based antioxidant (2,6-di-tert-butyl-p-cresol: DBPC) at 0.2% by mass to the lubricating base oil.

The lubricating base oil of the invention having this construction exhibits an excellent viscosity-temperature characteristic, low-temperature viscosity characteristic and flash point property, while also having low viscosity resistance and stirring resistance and improved heat and oxidation stability and frictional properties, making it possible to achieve an increased friction reducing effect and thus improved energy savings. When additives are included in the lubricating base oil of the invention, the functions of the additives (improved low-temperature viscosity characteristic with pour point depressants, improved heat and oxidation stability by antioxidants, increased friction reducing effect by friction modifiers, improved wear resistance by anti-wear agents, etc.) are exhibited at a higher level. The lubricating base oil of the invention can therefore be applied as a base oil for a variety of lubricant oils. The specific use of the lubricating base oil of the invention may be as a lubricant oil for an internal combustion engine such as a passenger vehicle gasoline engine, two-wheel vehicle gasoline engine, diesel engine, gas engine, gas heat pump engine, marine engine, electric power engine or the like (internal combustion engine lubricant oil), as a lubricant oil for a drive transmission such as an automatic transmission, manual transmission, non-stage transmission, final reduction gear or the like (drive transmission oil), as a hydraulic oil for a hydraulic power unit such as a damper, construction machine or the like, or as a compressor oil, turbine oil, industrial gear oil, refrigerator oil, rust preventing oil, heating medium oil, gas holder seal oil, bearing oil, paper machine oil, machine tool oil, sliding guide surface oil, electrical insulating oil, cutting oil, press oil, rolling oil, heat treatment oil or the like, and using the lubricating base oil of the invention for these purposes will allow the improved characteristics of the lubricant oil including the viscosity-temperature characteristic, heat and oxidation stability, energy savings and fuel efficiency to be exhibited at a high level, together with a longer lubricant oil life and lower levels of environmentally unfriendly substances.

The lubricating oil composition of the invention may be used alone as a lubricating base oil according to the invention, or the lubricating base oil of the invention may be combined with one or more other base oils. When the lubricating base oil of the invention is combined with another base oil, the proportion of the lubricating base oil of the invention in the total mixed base oil is preferably at least 30% by mass, more preferably at least 50% by mass and even more preferably at least 70% by mass.

There are no particular restrictions on the other base oil used in combination with the lubricating base oil of the invention, and as examples of mineral oil base oils there may be mentioned solvent refined mineral oils, hydrocracked mineral oils, hydrorefined mineral oils and solvent dewaxed base oils having kinematic viscosities at 100° C. of 1-100 $mm^2/s$.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, among which poly-α-olefins are preferred. As typical poly-α-olefins there may be mentioned C2-C32 and preferably C6-C16α-olefin oligomers or co-oligomers (1-octene oligomer, decene oligomer, ethylene-propylene co-oligomers and the like), and their hydrides.

There are no particular restrictions on the process for producing poly-α-olefins, and as an example there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The lubricating oil composition of the invention may also contain additives if necessary. Such additives are not particularly restricted, and any additives that are commonly employed in the field of lubricant oils may be used. As specific lubricant oil additives there may be mentioned antioxidants, ash-free dispersants, metal-based detergents, extreme-pressure agents, anti-wear agents, viscosity index improvers, pour point depressants, friction modifiers, oil agents, corrosion inhibitors, rust-preventive agents, demulsifiers, metal inactivating agents, seal swelling agents, antifoaming agents, coloring agents, and the like. These additives may be used alone or in combinations of two or more. Especially when the lubricating oil composition of the invention contains a pour point depressant, it is possible to achieve an excellent low-temperature viscosity characteristic (a MRV viscosity at −40° C. of preferably not greater than 60,000 mPa·s, more preferably not greater than 40,000 mPa·s and even more preferably not greater than 30,000 mPa·s) since the effect of adding the pour point depressant is maximized by the lubricating base oil of the invention.

EXAMPLES

The present invention will now be explained in greater detail based on examples and comparative examples, with the understanding that these examples are in no way limitative on the invention.

Example 1 and Comparative Example 1

For Example 1, first a fraction separated by vacuum distillation in a step of refining of solvent refined base oil was subjected to solvent extraction with furfural and then hydrotreatment, which was followed by solvent dewaxing with a methyl ethyl ketone-toluene mixed solvent. The wax portion removed during solvent dewaxing and obtained as slack wax (hereunder, "WAX1") was used as the feedstock oil for the lubricating base oil. The properties of WAX1 are shown in Table 1.

TABLE 1

| | |
|---|---|
| Name of crude wax | WAX1 |
| Kinematic viscosity at 100° C. ($mm^2/s$) | 6.3 |
| Melting point (° C.) | 53 |
| Oil content (% by mass) | 19.9 |
| Sulfur content (ppm by mass) | 1900 |

WAX1 was then used as the feedstock oil for hydrotreatment with a hydrotreatment catalyst. The reaction temperature and liquid space velocity during this time were controlled for a cracking severity of not greater than 10% by mass for the normal paraffins in the feedstock oil.

Next, the treated product obtained from the hydrotreatment was subjected to hydrodewaxing in a temperature range of 315° C.-325° C. using a zeolite-based hydrodewaxing catalyst adjusted to a precious metal content of 0.1-5% by mass.

The treated product (raffinate) obtained by this hydrodewaxing was subsequently treated by hydrorefining using a hydrorefining catalyst. Next, the light and heavy portions were separated by distillation to obtain a lubricating base oil having the composition and properties shown in Table 2. Table 2 also shows the compositions and properties of a conventional lubricating base oil obtained using WAX1, for Comparative Example 1. In Table 2, the row headed "Proportion of normal paraffin-derived components in urea adduct" means the values obtained by gas chromatography of the urea adduct obtained during measurement of the urea adduct value (same hereunder).

Example 2 and Comparative Example 2

For Example 2, the wax portion obtained by further deoiling of WAX1 (hereunder, "WAX2") was used as the feedstock oil for the lubricating base oil. The properties of WAX2 are shown in Table 3.

TABLE 3

| | |
|---|---|
| Name of crude wax | WAX2 |
| Kinematic viscosity at 100° C. ($mm^2/s$) | 6.8 |
| Melting point (° C.) | 58 |
| Oil content (% by mass) | 6.3 |
| Sulfur content (ppm by mass) | 900 |

Hydrotreatment, hydrodewaxing, hydrorefining and distillation were carried out in the same manner as in Example 1, except for using WAX2 instead of WAX1, to obtain a lubricating base oil having the composition and properties listed in Table 4. Table 4 also shows the compositions and properties of a conventional lubricating base oil obtained using WAX2, for Comparative Example 2.

TABLE 2

| | | Example 1 | Comp. Ex. 1 |
|---|---|---|---|
| Feedstock oil | | WAX1 | WAX1 |
| Urea adduct value, % by mass | | 1.11 | 4.18 |
| Proportion of normal paraffin-derived components in urea adduct, % by mass | | 1.8 | 6.8 |
| Base oil composition (based on total amount of base oil) | Saturated components, % by mass | 99.1 | 99.1 |
| | Aromatic components, % by mass | 0.5 | 0.5 |
| | Polar compound components, % by mass | 0.4 | 0.4 |
| Saturated components content (based on total amount of saturated components) | Cyclic saturated components, % by mass | 17.8 | 18.1 |
| | Acyclic saturated components, % by mass | 82.2 | 81.9 |
| Acyclic saturated components content (based on total amount of acyclic saturated components) | Normal paraffins, % by mass | 0 | 0.3 |
| | Isoparaffins, % by mass | 100 | 99.7 |
| Sulfur content, ppm by mass | | <1 | <1 |
| Nitrogen content, ppm by mass | | <3 | <3 |
| Kinematic viscosity (40° C.), $mm^2/s$ | | 31.1 | 32.18 |
| Kinematic viscosity (100° C.), $mm^2/s$ | | 6.26 | 6.47 |
| Viscosity index | | 154 | 160 |
| Flash point, ° C. | | 258 | 245 |
| Density (15° C.), $g/cm^3$ | | 0.8274 | 0.8269 |
| Pour point, ° C. | | −17.5 | −15 |
| Freezing point, ° C. | | −18 | −16 |
| Iodine value | | 0.04 | 0.09 |
| Aniline point, ° C. | | 124.9 | 124.6 |
| Distillation properties, ° C. | IBP, ° C. | 441 | 445 |
| | T10, ° C. | 467 | 470 |
| | T50, ° C. | 498 | 500 |
| | T90, ° C. | 515 | 518 |
| | FBP, ° C. | 520 | 530 |
| CCS viscosity (−35° C.), mPa · s | | 7,100 | 13,500 |

TABLE 4

| | | Example 2 | Comp. Ex. 2 |
|---|---|---|---|
| Feedstock oil | | WAX2 | WAX2 |
| Urea adduct value, % by mass | | 0.85 | 4.22 |
| Proportion of normal paraffin-derived components in urea adduct, % by mass | | 1.9 | 7.1 |
| Base oil composition (based on total amount of base oil) | Saturated components, % by mass | 99.5 | 99.4 |
| | Aromatic components, % by mass | 0.3 | 0.3 |
| | Polar compound components, % by mass | 0.2 | 0.3 |
| Saturated components content (based on total amount of saturated components) | Cyclic saturated components, % by mass | 15.5 | 15.7 |
| | Acyclic saturated components, % by mass | 84.5 | 84.3 |
| Acyclic saturated components content (based on total amount of acyclic saturated components) | Normal paraffins, % by mass | 0 | 0.3 |
| | Isoparaffins, % by mass | 100 | 99.7 |
| Sulfur content, ppm by mass | | <1 | <1 |
| Nitrogen content, ppm by mass | | <3 | <3 |
| Kinematic viscosity (40° C.), $mm^2/s$ | | 29.03 | 30.22 |
| Kinematic viscosity (100° C.), $mm^2/s$ | | 5.932 | 6.158 |
| Viscosity index | | 155 | 158 |
| Flash point, ° C. | | 260 | 244 |
| Density (15° C.), $g/cm^3$ | | 0.8260 | 0.8258 |
| Pour point, ° C. | | −20 | −17.5 |
| Freezing point, ° C. | | −21 | −20 |
| Iodine value | | 0.07 | 0.08 |
| Aniline point, ° C. | | 125.4 | 125.8 |
| Distillation properties, ° C. | IBP, ° C. | 436 | 439 |
| | T10, ° C. | 464 | 467 |
| | T50, ° C. | 494 | 499 |
| | T90, ° C. | 515 | 513 |
| | FBP, ° C. | 530 | 529 |
| CCS viscosity (−35° C.), mPa · s | | 6,800 | 13,000 |

Example 3 and Comparative Example 3

For Example 3 there was used an FT wax with a paraffin content of 95% by mass and a carbon number distribution of 20-80 (hereunder, "WAX3"). The properties of WAX3 are shown in Table 5.

TABLE 5

| | |
|---|---|
| Name of crude wax | WAX3 |
| Kinematic viscosity at 100° C. ($mm^2/s$) | 5.8 |

TABLE 5-continued

| | |
|---|---|
| Melting point (° C.) | 70 |
| Oil content (% by mass) | <1 |
| Sulfur content (ppm by mass) | <0.2 |

Hydrotreatment, hydrodewaxing, hydrorefining and distillation were carried out in the same manner as in Example 1, except for using WAX3 instead of WAX1, to obtain a lubricating base oil having the composition and properties listed in Table 6. Table 6 also shows the compositions and properties of a conventional lubricating base oil obtained using WAX3, for Comparative Example 3.

TABLE 6

| | | Example 3 | Comp. Ex. 3 |
|---|---|---|---|
| Feedstock oil | | WAX3 | WAX3 |
| Urea adduct value, % by mass | | 0.81 | 4.88 |
| Proportion of normal paraffin-derived components in urea adduct, % by mass | | 1.8 | 7.0 |
| Base oil composition (based on total amount of base oil) | Saturated components, % by mass | 99.8 | 99.6 |
| | Aromatic components, % by mass | 0.1 | 0.3 |
| | Polar compound components, % by mass | 0.1 | 0.1 |
| Saturated components content (based on total amount of saturated components) | Cyclic saturated components, % by mass | 15.3 | 14.8 |
| | Acyclic saturated components, % by mass | 84.7 | 85.2 |
| Acyclic saturated components content (based on total amount of acyclic saturated components) | Normal paraffins, % by mass | 0 | 0.3 |
| | Isoparaffins, % by mass | 100 | 99.7 |
| Sulfur content, ppm by mass | | <10 | <10 |
| Nitrogen content, ppm by mass | | <3 | <3 |
| Kinematic viscosity (40° C.), $mm^2/s$ | | 32.22 | 31.55 |

TABLE 6-continued

| | | Example 3 | Comp. Ex. 3 |
|---|---|---|---|
| Kinematic viscosity (100° C.), $mm^2/s$ | | 6.472 | 6.392 |
| Viscosity index | | 159 | 158 |
| Flash point, ° C. | | 262 | 241 |
| Density (15° C.), $g/cm^3$ | | 0.8259 | 0 |
| Pour point, ° C. | | −20 | −17.5 |
| Freezing point, ° C. | | −21 | −19 |
| Iodine value | | 0.10 | 0.02 |
| Aniline point, ° C. | | 125.3 | 123.9 |
| Distillation properties, ° C. | IBP, ° C. | 442 | 450 |
| | T10, ° C. | 470 | 472 |
| | T50, ° C. | 495 | 498 |
| | T90, ° C. | 514 | 515 |
| | FBP, ° C. | 529 | 530 |
| CCS viscosity (−35° C.), mPa · s | | 6,700 | 12,200 |

Comparative Examples 4-6

Comparative Example 4 is a lubricating base oil obtained by solvent refining-solvent dewaxing treatment, Comparative Example 5 is a lubricating base oil obtained by isomerization dewaxing of the bottom fraction (HDC bottom) obtained from a fuel oil hydrocracking apparatus, the fuel oil hydrocracking apparatus having a high hydrogen pressure, and Comparative Example 6 is a base oil obtained by solvent dewaxing of the bottom fraction (HDC bottom) obtained from a fuel oil hydrocracking apparatus, the fuel oil hydrocracking apparatus also having a high hydrogen pressure as in Comparative Example 5.

TABLE 7

| | | Comp. Ex. 4 | Comp. Ex. 5 | Comp. Ex. 6 |
|---|---|---|---|---|
| Base oil category | | GpI | GpIII | GpIII |
| Stock material | | Feedstock oil | HDC bottom | HDC bottom |
| Dewaxing method | | Solvent dewaxing | Isomerization dewaxing | Solvent dewaxing |
| Urea adduct value, % by mass | | 2.85 | 2.18 | 4.66 |
| Proportion of normal paraffin-derived components in urea adduct, % by mass | | 1.02 | 2.33 | 4.88 |
| Base oil composition (based on total amount of base oil) | Saturated components, % by mass | 99.5 | 99.6 | 93.3 |
| | Aromatic components, % by mass | 0.4 | 0.3 | 6.6 |
| | Polar compound components, % by mass | 0.1 | 0.1 | 0.1 |
| Saturated components content (based on total amount of saturated components) | Cyclic saturated components, % by mass | 46.5 | 46.1 | 51.0 |
| | Acyclic saturated components, % by mass | 53.5 | 53.9 | 49.0 |
| Acyclic saturated components content (based on total amount of acyclic saturated components) | Normal paraffins, % by mass | 0.2 | 0.2 | 0.2 |
| | Isoparaffins, % by mass | 99.8 | 99.8 | 99.8 |
| Sulfur content, ppm by mass | | <1 | <1 | 6 |
| Nitrogen content, ppm by mass | | <3 | <3 | <3 |
| Kinematic viscosity (40° C.), $mm^2/s$ | | 34.63 | 33.15 | 34.91 |
| Kinematic viscosity (100° C.), $mm^2/s$ | | 6.303 | 6.146 | 6.378 |
| Viscosity index | | 134 | 135 | 145 |
| Flash point, ° C. | | 235 | 245 | 252 |
| Density (15° C.), $g/cm^3$ | | 0.8400 | 0.8433 | 0.8446 |
| Pour point, ° C. | | −12.5 | −12.5 | −17.5 |
| Freezing point, ° C. | | −14 | −13 | −19 |
| Iodine value | | 0.03 | 0.02 | 5.30 |
| Aniline point, ° C. | | 124.1 | 125.1 | 121.3 |
| Distillation properties, ° C. | IBP, ° C. | 310 | 312 | 316.8 |
| | T10, ° C. | 422 | 425 | 411 |
| | T50, ° C. | 472 | 473 | 477 |
| | T90, ° C. | 528 | 529 | 525 |
| | FBP, ° C. | 580 | 585 | 576 |
| CCS viscosity (−35° C.), mPa · s | | 18,600 | 14,800 | 17,500 |

The invention claimed is:

1. A lubricating base oil having a urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher.

2. A method for producing a lubricating base oil comprising a step of hydrocracking/hydroisomerizing a feedstock oil containing normal paraffins so as to obtain a treated product having an urea adduct value of not greater than 4% by mass, a kinematic viscosity at 40° C. of 25-50 $mm^2/s$, a viscosity index of 140 or greater, a CCS viscosity at −35° C. of not greater than 15,000 mPa·s and a flash point of 250° C. or higher.

3. A lubricating oil composition comprising a lubricating base oil according to claim 1.

* * * * *

UNITED STATES PATENT AND TRADEMARK OFFICE

CERTIFICATE OF CORRECTION

PATENT NO. : 8,227,385 B2
APPLICATION NO. : 12/934472
DATED : July 24, 2012
INVENTOR(S) : K. Tagawa et al.

It is certified that error appears in the above-identified patent and that said Letters Patent is hereby corrected as shown below:

Title Page, Item (86) Filing Date or 371 (c) of the printed patent, please change "Sep. 24, 2010" to -- Nov. 17, 2010 --.

Signed and Sealed this
Twelfth Day of March, 2013

Teresa Stanek Rea
*Acting Director of the United States Patent and Trademark Office*